US011510451B2

(12) United States Patent
Sanders et al.

(10) Patent No.: US 11,510,451 B2
(45) Date of Patent: Nov. 29, 2022

(54) CHIN STRAP FOR A SAFETY HELMET

(71) Applicant: JSP Limited, Witney (GB)

(72) Inventors: Stephen Sanders, Witney (GB); Clive Johnstone, Witney (GB)

(73) Assignee: JSP LIMITED, Witney (GB)

( * ) Notice: Subject to any disclaimer, the term of this patent is extended or adjusted under 35 U.S.C. 154(b) by 392 days.

(21) Appl. No.: 16/466,859

(22) PCT Filed: Nov. 27, 2017

(86) PCT No.: PCT/GB2017/053549
§ 371 (c)(1),
(2) Date: Jun. 5, 2019

(87) PCT Pub. No.: WO2018/104701
PCT Pub. Date: Jun. 14, 2018

(65) Prior Publication Data

US 2019/0350296 A1 Nov. 21, 2019

(30) Foreign Application Priority Data

Dec. 6, 2016 (GB) ..... 1620694

(51) Int. Cl.
*A42B 3/08* (2006.01)
*A42B 7/00* (2006.01)
*A44B 11/25* (2006.01)

(52) U.S. Cl.
CPC ..... *A42B 3/08* (2013.01); *A42B 7/00* (2013.01); *A44B 11/2592* (2013.01)

(58) Field of Classification Search
CPC .. A42B 3/08; A42B 3/085; A42B 7/00; A44B 11/622; A44B 11/2592
See application file for complete search history.

(56) References Cited

U.S. PATENT DOCUMENTS 2,825,112 A * 3/1958 Frieder ..... A42B 3/08 24/601.6
4,044,725 A * 8/1977 Miller ..... A01K 27/001 59/84

(Continued)

FOREIGN PATENT DOCUMENTS

DE 202011107018 B1 1/2012
EP 3165108 A1 5/2017

(Continued)

OTHER PUBLICATIONS

International Search Report and Written Opinion from PCT/GB2017/053549, completed Jan. 23, 2018, 12 pages.
Search Report from GB1620694.8, dated Mar. 30, 2017, 6 pages.

*Primary Examiner* — F Griffin Hall
(74) *Attorney, Agent, or Firm* — Faegre Drinker Biddle & Reath LLP

(57) ABSTRACT

A chinstrap harness for a safety helmet, the chinstrap harness comprising first and second elongate side sections of flexible material (12*a*, 12*b*, 12*c*), each side section having a first end and an opposing second end, wherein said first end comprises means (3*a*, 3*b*) to connect said chinstrap harness to a safety helmet, and the opposing second end of each side section includes means (1) for releasably coupling said side sections adjacent a user's face. In use, said first side section (12*b*, 12*c*) incorporating along its length, and intermediate its first and second ends, a safety device (10) coupled across a break in said second side section (12*b*, 12*c*), said safety device (10) being selectively configurable between a first configuration, in which said safety device is free to release when a tensile force applied to said chinstrap harness exceeds a first predetermined threshold, and a second configuration, in which it can sustain, without releasing, a tensile force of at least a second predetermined threshold, (Continued)

said second predetermined threshold being greater than said first predetermined threshold.

10 Claims, 7 Drawing Sheets

(56) References Cited

U.S. PATENT DOCUMENTS 4,881,492 A * 11/1989 Jones ..... A01K 27/005 24/478
5,027,477 A * 7/1991 Seron ..... A44B 11/2584 24/3.13
5,079,780 A * 1/1992 Coombs ..... A42B 3/08 2/5
5,144,725 A 9/1992 Krauss
5,311,649 A 5/1994 Suh
5,419,020 A 5/1995 Murai
5,548,879 A 8/1996 Wu
5,675,875 A 10/1997 Servatius
6,073,317 A * 6/2000 Barison ..... A44B 11/2588 24/115 F
6,157,298 A * 12/2000 Garfinkel ..... A42B 3/0466 340/463
6,360,404 B1 * 3/2002 Mudge ..... A01K 27/005 24/115 F
6,539,588 B1 * 4/2003 Brosofsky ..... G09F 21/02 24/165
6,615,460 B1 9/2003 Baumgarten
6,826,806 B2 * 12/2004 Eaton ..... A44B 11/25 24/584.1
7,107,657 B1 * 9/2006 Howell ..... A44B 11/263 24/615
8,726,850 B2 * 5/2014 Rosenquist ..... A44B 11/266 119/863
10,039,351 B2 * 8/2018 Allen ..... A63H 33/3088
2006/0123607 A1 * 6/2006 Howell ..... A44B 11/263 24/615
2007/0199182 A1 * 8/2007 Johnson ..... A44B 11/2542 24/265 BC
2009/0100652 A1 4/2009 Mok
2014/0096310 A1 * 4/2014 Szalkowski ..... A42B 3/085 2/411
2016/0174647 A1 * 6/2016 Benton ..... A42B 3/08 2/421
2017/0049191 A1 * 2/2017 Prugue ..... A44B 11/04
2017/0119079 A1 5/2017 Coursimault
2019/0166957 A1 * 6/2019 Schuss ..... A44B 11/266
2021/0274754 A1 * 9/2021 Talley ..... G08B 7/06

FOREIGN PATENT DOCUMENTS

GB 2431199 A 4/2007
GB 2531146 A 4/2016
GB 2531146 B 8/2016

* cited by examiner

CHIN STRAP FOR A SAFETY HELMET

This invention relates generally to a chinstrap for a safety helmet and, more particularly but not necessarily exclusively, to a safety device for a chinstrap for use with a safety helmet, to enable the safety helmet to be used in two or more different hazardous environments. The invention extends to a chinstrap including such a safety device and to a safety helmet incorporating such a chinstrap.

Safety helmets are well known and their use is mandatory (or at least recommended) for use in many different potentially hazardous environments and for many different potentially hazardous activities.

For example, activities and environments governed by Industrial Safety Regulations require operatives to wear a safety helmet at all times, to protect them whilst they are working at ground or low levels from falling debris and similar hazards, whereas other activities in the same or different environments require an operative to wear a safety helmet whilst working or otherwise operating at height, to protect them in the event of a fall, for example. The European safety standard governing safety helmets for use at low levels is EN397 and that governing safety helmets for use at height is EN12492.

A key difference between the above-mentioned two safety helmet standards lies principally in the chinstrap. A safety helmet which conforms to the EN397 standard is required to have a chinstrap which releases or fails when the tensile force on it reaches between 150 and 250 Newtons (N). The reason for this is largely to reduce the risk of strangulation if the user falls and their helmet becomes trapped. In contrast, a safety helmet which conforms to the EN12492 standard is required to have a chinstrap which does not release or fail up to an exerted tensile force of at least 500 N. Furthermore, the chinstrap must not stretch more than 25 mm for a period of 2 minutes. The two standards are, therefore, mutually exclusive in that a chinstrap which conforms to one of the standards cannot conform to the other.

FIG. 1 shows a simple schematic diagram of a conventional chinstrap harness comprising a buckle 1, anchorage devices 2, and helmet connectors 3. In most current safety helmets, the point of release or failure may be concentrated in the buckle 1, or at the helmet connectors 3, as these are obvious points of weakness. Therefore, safety helmets which conform to either standard will have a specific set of buckles 1 or connectors 3.

This means that the helmet as a whole may conform to either EN397 or EN12492, but not both. One solution is for the user to carry two complete helmets (including chinstraps) with them. This is impractical as it requires a user to carry with them extra equipment, and the act of swapping over the helmets takes time. The user is required to remove one helmet before putting on the other, resulting in a short time of increased risk. Additionally, companies which provide such helmets for their employees are spending extra money on additional safety equipment, and this solution is uneconomical. Therefore it is desirable in the field to provide a single helmet with dual functionality.

It is known to provide a safety helmet comprising replaceable (and, therefore, interchangeable) chinstrap harnesses. One of the chinstrap harnesses has a weaker buckle connection to comply with safety standard EN397, whilst a second chinstrap harness has a stronger buckle connection to comply with safety standard EN12492. Thus, users only need to carry a single helmet. However, the prior art creates further problems, in that there is still a need to carry an extra chinstrap harness which may also be lost or misplaced, or become damaged when not in use. The act of swapping over the chinstrap harnesses is time consuming for the user and can be inconvenient. In a hurry, a user may not take the time to ensure they are fitting the correct chinstrap harness to the safety helmet which is appropriate for the task, resulting in a high risk to the safety of the user. It may also be difficult to fit a chinstrap harness without first removing the safety helmet thus, once again, introducing a short period of time when the user is exposed to risk.

Referring to FIG. 2, UK Patent No. GB2531146B describes a chinstrap for a helmet comprising a buckle 1 which has two settings. At a first setting, the buckle is configured to fail if the force applied to it exceeds a predetermined threshold (i.e. 150 N-250 N if EN397 is to be conformed to). At a second setting, the buckle is configured to withstand a much higher tensile force (500 N or more) before it will release or fail. The buckle setting is selected/changed by rotating a dial 4 on the release mechanism. In this device, the buckle 1 comprises male 5 and female 6 connectors. The male connector 5 comprises a sloped upper surface giving the male connector a narrow 7 and a wide 8 end. The wide end 8 has an edge which extends perpendicularly to the planar surface of the male connector. When the male connector is pushed together with the female connector, the sloped surface passes through a gap and then extends through an aperture 9 in the upper surface of the female connector. The edge of the sloped surface abuts against the inner edge 10 of the aperture on the female connector. A tool can be used to rotate the sloped surface via the dial 4 such that the narrower or wider edge of the male connector abuts against the aperture edge 10, giving the buckle a lower or higher failure force limit respectively.

There are a number of issues associated with the device described in GB2531146A. Firstly, the safety mechanism is integral with the buckle. This means that repeated (normal) use of the buckle over time will have a long term negative effect on the failure force limit provided by the safety device. This reduces the reliability and longevity of the chinstrap, and may result in an operative inadvertently using a helmet assembly that does not conform to the required standard.

Furthermore, the user is required to use a tool in order to switch between the two settings. This presents the same problem as the other prior art solutions: a small tool can be lost or misplaced, and the act of switching between the settings is inconvenient. A user cannot engage the tool themselves without removing the helmet, thus, potentially exposing themselves to a period of high risk.

It is an object of aspects of the present invention to address at least some of these issues and, in accordance with a first aspect of the present invention, there is provided a chinstrap harness for a safety helmet, the chinstrap harness comprising first and second elongate side sections of flexible material, each side section having a first end and an opposing second end, wherein said first end comprises means to connect said chinstrap harness to a safety helmet, and the opposing second end of each side section includes means for releasably coupling said side sections adjacent a user's face, in use, said first side section incorporating along its length, and intermediate its first and second ends, a safety device coupled across a break in said second side section, said safety device being selectively configurable between a first configuration, in which said safety device is free to release when a tensile force applied to said chinstrap harness exceeds a first predetermined threshold, and a second configuration, in which it can sustain, without releasing, a tensile force of at least a second predetermined threshold, said second predetermined threshold being greater than said first predetermined threshold.

The second side section may, in an exemplary embodiment of the invention, comprise, along its length intermediate its first and second ends, an anchorage device. The anchorage device may, optionally, be configured to allow selective adjustment of the length of said second side section. The safety device may be formed integrally with a fixed anchorage device incorporated in the first side section, intermediate its first and second ends.

In an exemplary embodiment, the safety device may comprise male and female component parts configured, in use, to be connected together across the break, and a manually operable switching mechanism including a switch moveable between a first position corresponding to a first configuration of said chinstrap harness, and a second position corresponding to a second configuration of said chinstrap harness. Advantageously, the switch may be manually slidable, in use, along a generally linear path between said first and said second positions by a finger or thumb.

The male component part of said safety device may comprise at least two substantially parallel, spaced-apart prongs defining a gap therebetween, said prongs being resiliently flexible. In this case, the switching mechanism may include an obstruction to which said switch is mechanically coupled, said obstruction being moved away from said gap between said prongs when said switch is moved into said first position, and said obstruction being moved substantially into said gap between said prongs when said switch is moved into said second position. The prongs may be configured to flex inwardly towards each other when the tensile force on said chinstrap harness exceeds a first predetermined threshold in a first configuration. In contrast, the prongs may be prevented from flexing inwardly by said obstruction at least when the tensile force on the chinstrap is less than said second predetermined threshold.

The side sections may, advantageously, be comprised of a woven polymeric fabric which have a tensile strength at least greater than said second predetermined threshold; and the means for releasably coupling said first section and second section of said chinstrap harness may comprise a releasable clip or buckle.

In accordance with another aspect of the present invention, there is provided a safety device for a chinstrap harness configured, in use, to be coupled to a safety helmet, wherein said safety device is configured to be coupled across a break in said chinstrap harness and is selectively configurable by a switching mechanism between a first configuration, in which said safety device is free to release when a tensile force applied to said chinstrap harness exceeds a first predetermined threshold, and a second configuration, in which it can sustain, without releasing, a tensile force of at least a second predetermined threshold, said second predetermined threshold being greater than said first predetermined threshold, wherein said switching mechanism includes a switch that is manually slidable by a finger or thumb, in use, along a generally linear path between a first position corresponding to said first configuration and a second position corresponding to said second configuration.

In an exemplary embodiment, the safety device may comprise male and female component parts configured, in use, to be connected together across said break, said male component part comprising at least two substantially parallel, spaced-apart prongs defining a gap therebetween, said prongs being resiliently flexible.

The switching mechanism may comprise an obstruction to which said switch is mechanically coupled, said obstruction being moved away from said gap between said prongs when said switch is moved into said first position, and said obstruction being moved into said gap between said prongs when said switch is moved into said second position. The prongs may be configured to flex inwardly (toward each other) when the tensile force on said chinstrap harness exceeds a first predetermined threshold said safety device is in said first configuration. In the second configuration, said prongs may be prevented from flexing inwardly by said obstruction when the tensile force on the chinstrap is at least less than said second predetermined threshold.

In accordance with yet another aspect of the present invention, there is provided a kit of parts comprising a chinstrap harness substantially as described above, and a safety helmet comprising means for enabling said chinstrap harness to be connected thereto such that, in use when said safety helmet is worn on a user's head, said side sections extend down respective sides of the user's face and the second ends thereof are, or can be, releasably coupled together adjacent the user's face.

The chinstrap harness may further comprise a safety device substantially as described above.

Thus, in accordance with a first aspect of the invention, the selectively configurable safety device may be incorporated intermediate the two ends of one of the side sections of the chinstrap, possibly in place of one of the anchorage devices provided in prior art arrangements of the type described above, instead of in the releasable clip or buckle mechanism used to secure the helmet to a user's head. This prevents the above-mentioned problem of long-term negative impact on the safety device due to repeated (normal) use of the clip or buckle. Furthermore, a second aspect of the invention provides a switching mechanism that includes a switch that is manually slidable along a linear path by the user's finger or thumb, and thus does not require a tool to reconfigure the safety device between the two specified configurations. A third aspect combines these two aspects, to provide a chinstrap harness that incorporates a safety device according to the second aspect at a location along one of the side sections of the chinstrap, and separate from the releasable buckle or clip, thereby combining the benefits of both of the first mentioned aspects.

These and other aspects of the present invention will be apparent from the following specific description, in which embodiments of the present invention are described, by way of examples only, and with reference to the accompanying drawings, in which.

Figure 1:
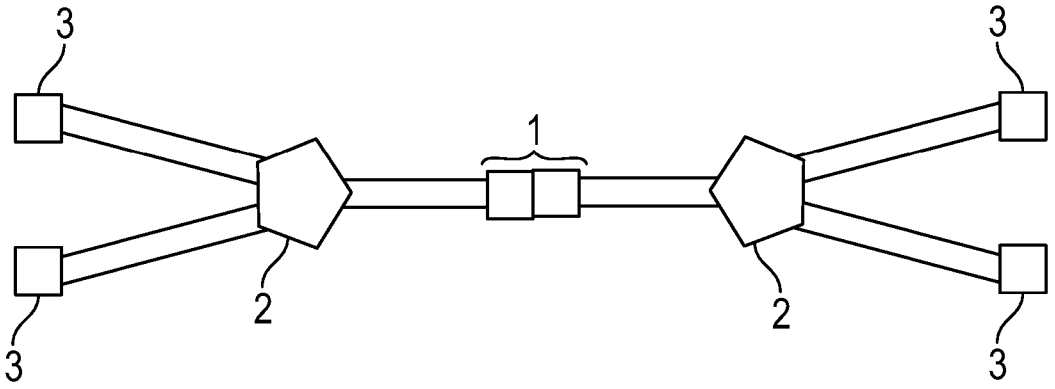
Figure. 1 PRIOR ART
FIG. 1 is a schematic diagram showing a top-down view of the main basic components of a conventional prior art chin-strap.
Figure 2:
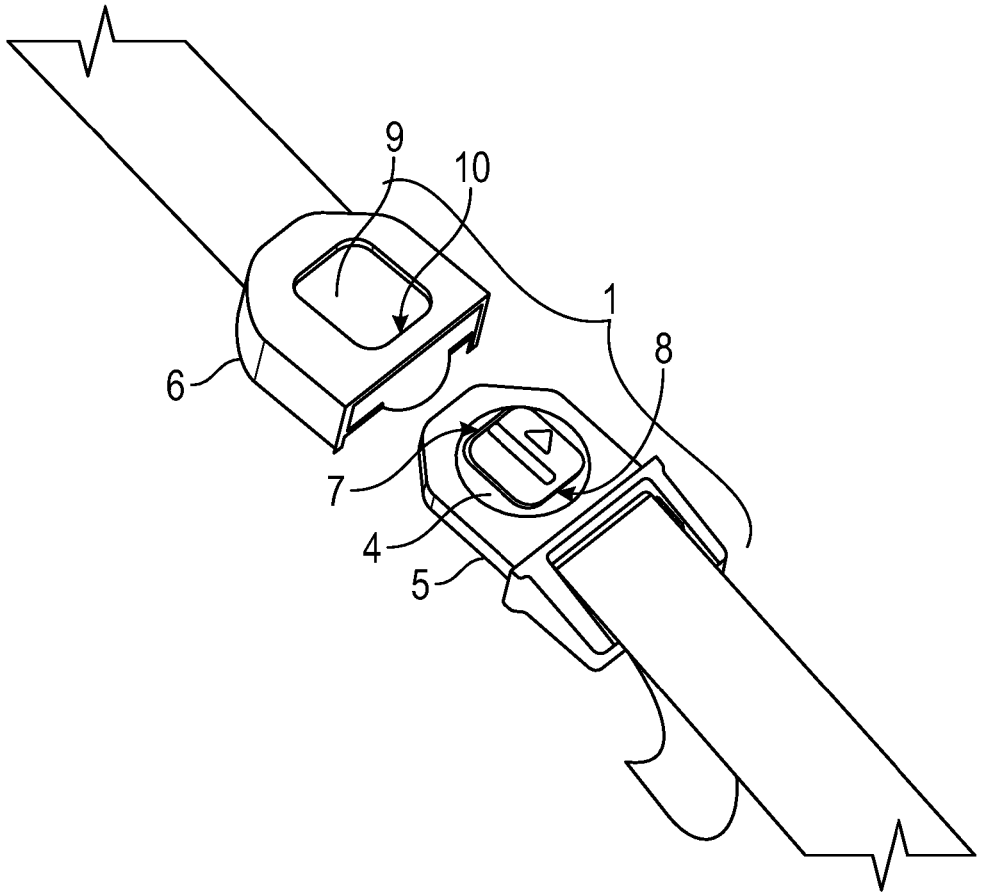
Figure. 2 PRIOR ART
FIG. 2 is a schematic close up of the buckle portion of the prior art device of GB2431199A.
Figure 3:
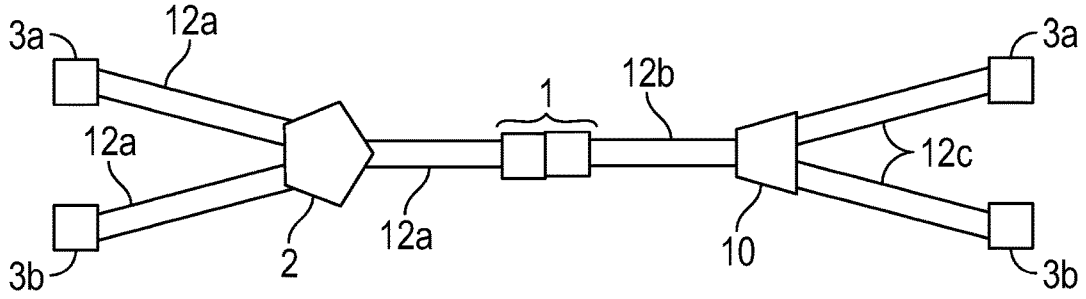
FIG. 3 is a schematic diagram showing a top-down view of a chinstrap harness incorporating an exemplary embodiment of the present invention.

Referring to FIG. 3 of the drawings, a chinstrap harness according to an exemplary embodiment of the present invention, for a safety helmet comprises helmet connectors 3, a single, substantially conventional anchorage device 2, a buckle 1, and a single safety device 10, wherein the helmet connectors 3 are connected to the anchorage device 2 and safety device 10, and the anchorage device 2 and safety device 10 are connected to the buckle 1, by means of respective chinstraps 12.

The helmet connectors 3 may be standard industry components, such as those known in the art. The helmet connectors 3 are advantageously configured so as to enable selective adjustment of the length of the chinstraps 12. A safety device 10 according to an exemplary embodiment of the present invention, is fitted on one side, in place of a conventional anchorage device. Thus, the chinstrap harness can be fitted to a safety helmet in a manner known in the art, such that the chinstraps 12 extend down respective sides of a user's face and pass under the chin, and can then be connected together by the buckle 1. In FIG. 3, the chinstraps 12 are denoted with reference to three portions, 12*a*, 12*b* and 12*c* wherein reference numeral 12*a* denotes the portion of the chinstraps extending from the helmet connectors 3*a*, 3*b* on one side of the safety helmet to the anchorage device 2, and from the anchorage device 2 to the buckle 1; 12*b* denotes the portion between the buckle 1 and the safety device 10; and 12*c* denotes the portions extending from the safety device 10 to the helmet connectors 3*a*, 3*b* on the opposite side of the helmet.

The buckle 1 comprises male and female buckle components formed of resiliently flexible plastic material, or the like. The male buckle component is connected to chinstrap portion 12*a* and has two side arms with ridged ends, the ridged ends making the effective width of the male buckle component greater than the aperture defined in the female component. The female component is coupled to chinstrap portion 12*b* and comprises a substantially cuboidal cavity with an opening or aperture at one end, and two side apertures. The arms of the male component flex inwardly as it is pushed into the aperture defined by the female buckle component, until the ridges reach corresponding respective side apertures in the female buckle component at which point they are released back to their non-flexed configuration, such that the buckle components are secured together, joining chinstrap portions 12*a* and 12*b*. To release the chinstraps 12*a*, 12*b*, the user simply pushes the two exposed ridges of the male buckle component inwardly whilst pulling the two buckle components apart.

The chinstraps 12 may be comprised of a woven polymer material as is known in the art, but must have a tensile strength of over the minimum tensile force defined by safety standard EN12492, or its equivalent.

The conventional anchorage device 2, as in prior art devices, provides a point in the harness which distributes the force equally along three directions. Each side of the chinstrap harness connects to the helmet by two helmet connectors, 3*a* and 3*b*. The anchorage device 2 pulls the two chinstraps extending from helmet connectors 3*a* and 3*b* together, so that the chinstrap between the anchorage device 2 and the buckle 1 is effectively a double chinstrap. In use, a user may adjust the position of the convention anchorage device 2 by moving it closer to the helmet connectors 3*a*, 3*b* or closer to the buckle 1 to shorten or lengthen the chinstrap as required. Such anchorage devices 2 are well known in the art and usually comprise a releasable clip of a rigid material. In a first configuration the clip is closed and the conventional anchorage device is fixed in position, whilst in a second configuration the clip is opened and the conventional anchorage device is movable along the chinstrap harness, to adjust its length.

On the other side of the buckle 1, as shown FIG. 3 of the drawings, there is provided a safety device 10 according to an exemplary embodiment of the present invention. This safety device 10 comprises three component parts, which are described in more detail later on. The safety device 10 is coupled between chinstrap portions 12*c* and 12*b*, during normal use, and provides the point of failure in the chinstrap harness, when the harness is subjected to a predetermined tensile force. As will be described in more detail, the safety anchorage device can be selectively configured to one of two settings, which, in this exemplary embodiment, correspond to two respective safety standards, namely, EN397, and EN12492.

Figure 4A:
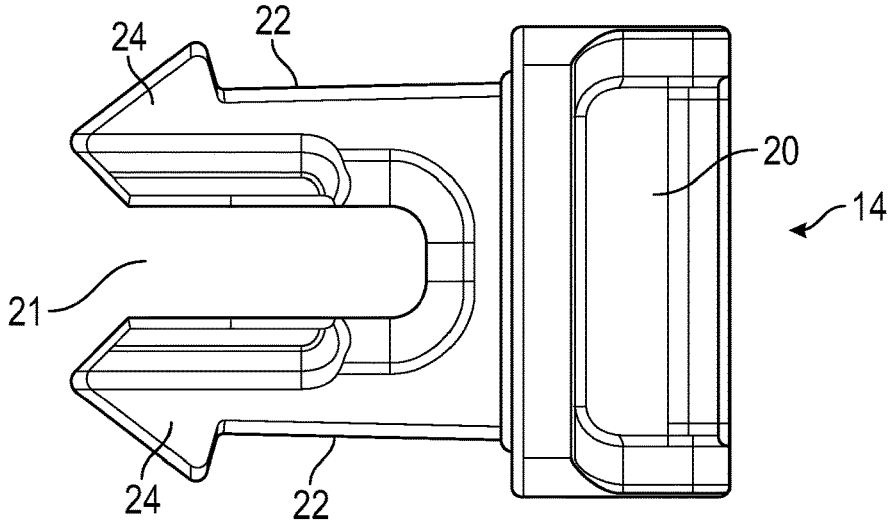
FIGS. 4A and 4B are schematic diagrams of the male and female component parts of the safety anchorage device of FIG. 4.
Figure 4B:
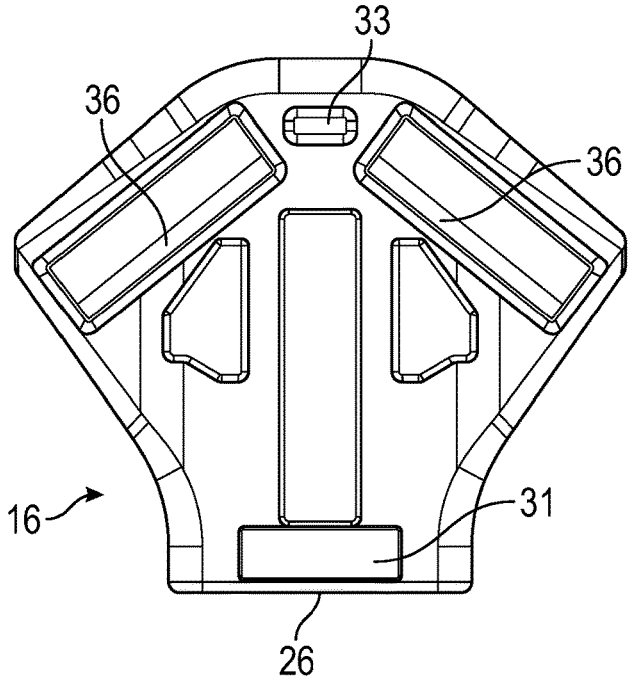
Figure 4:
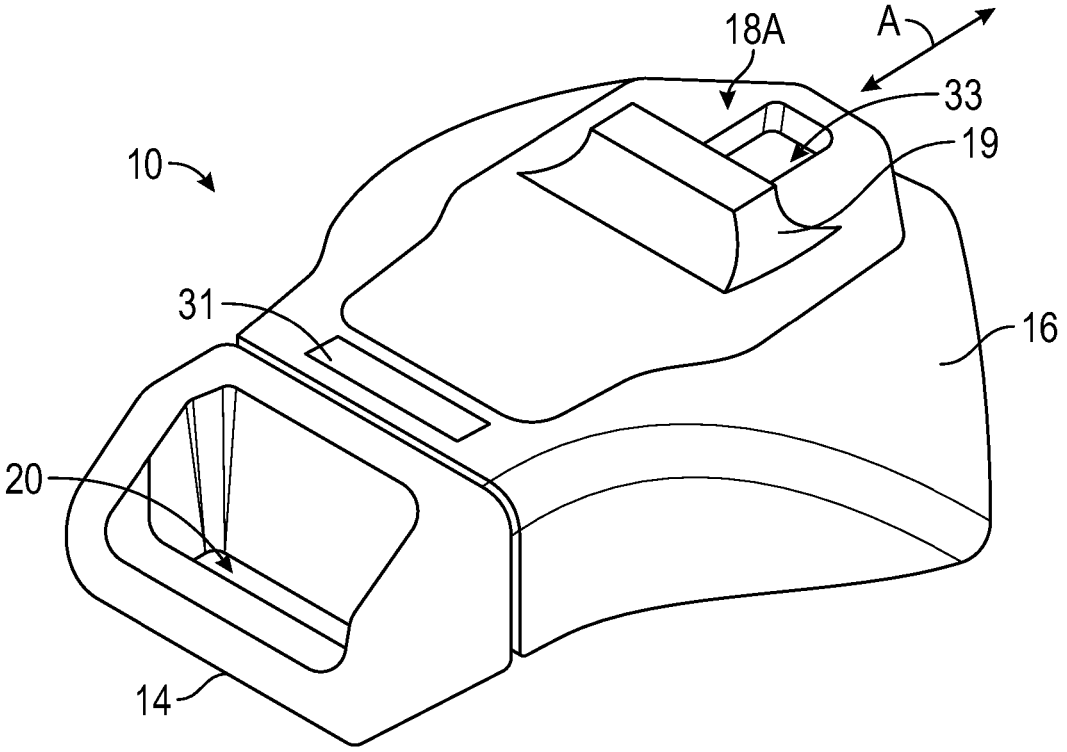
FIG. 4 is a schematic diagram of a perspective view of the safety anchorage device according to one exemplary embodiment of the present invention.
Figure 5A:
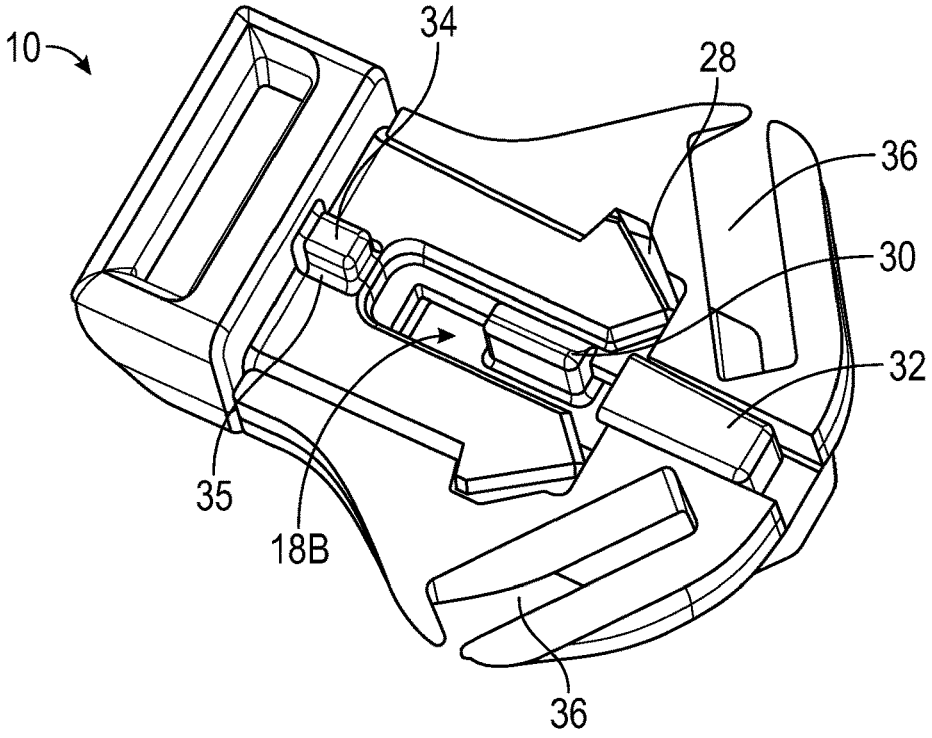
FIG. 5A is a schematic planar cross-sectional view of the safety anchorage device of FIG. 4, showing the device in a first configuration.

Referring to FIGS. 4 and 5A of the drawings, a safety device 10 according to an exemplary embodiment of the present invention is illustrated in a first configuration. The device 10 comprises three component parts, namely a male portion 14, a female portion 16 and a switch 18.

The male portion 14 is fixedly coupled to chinstrap portion 12*b*, and is comprised of a durable rigid plastic or similar resiliently flexible material, which is strong and durable but still has some degree of elasticity such that is can be temporarily flexed. The chinstrap 12*b* is looped through an aperture 20 at one end of the male portion 14 and folded back on itself. The chinstrap 12*b* is secured in place by robust stitching with a polymeric thread or similar material.

The female portion 16 comprises an upper surface on which the switch 18 is situated. The upper surface of the female portion comprises two indicators 31, 33, only one of which is exposed or visible, in use, depending on the position of the switch 18 (and, therefore, the selected setting of the safety device). Indicators 31, 33 therefore provide a distinctive visual indication of the setting to which the device is configured. The female portion comprises openings 36 through which chinstrap 12*c* are looped. No portion of chinstrap 12 extends over the safety device 10. This is important as the safety device 10 is the point of failure for the chinstrap harness and, therefore, must be able to break apart cleanly when triggered.

The switch 18 is situated on the upper planar surface of the female portion 16. The switch 18 comprises an upper surface 18A, on which there is a switch actuator 19. The switch actuator 19 is a raised portion of the switch's surface which allows the user to manually push and slide the switch in one direction or the other relative to the upper plane of the female portion 16, as shown by arrow A Referring specifically to FIG. 4A, the male portion 14 comprises two, substantially parallel, spaced-apart prongs 22 which extend away from the aperture 20, defining a gap 21 therebetween. Each prong 22 has a respective substantially triangularly-shaped tooth 24 oriented such that the edge of the prong 22 facing in towards the gap 21 is linear and smooth and the edge of the prong 22 facing away from the gap 21 has a tooth 24 which juts out from the side of the prong 22.

Referring to FIG. 4B, the female portion 16 comprises a generally 'T'-shaped component having an opening 26 in the base of the narrow end which is configured to be approximately equal to the size of base of the prongs 22 nearest the aperture 20 of the male portion 14. This means that the opening 26 is smaller than the distance between the tips of the teeth 24 of the prongs. The prongs 22 of the male portion 14 can be manually forced through the opening 26 of the female portion 16, such that the tapered edges of the teeth 24 engage with the inner side walls of the opening 26 and cause the prongs to flex slightly inward to allow them to pass through. In the wider part of the general 'T'-shape of the female portion 16, there is a cavity 28 which is profiled to follow the outer edge of the prongs 22. Once through the narrower portion of the opening 26, the flexing force on the prongs is released and the teeth 24 abut against the profiled walls of the cavity, securing the male portion 14 in place.

Figure 5B:
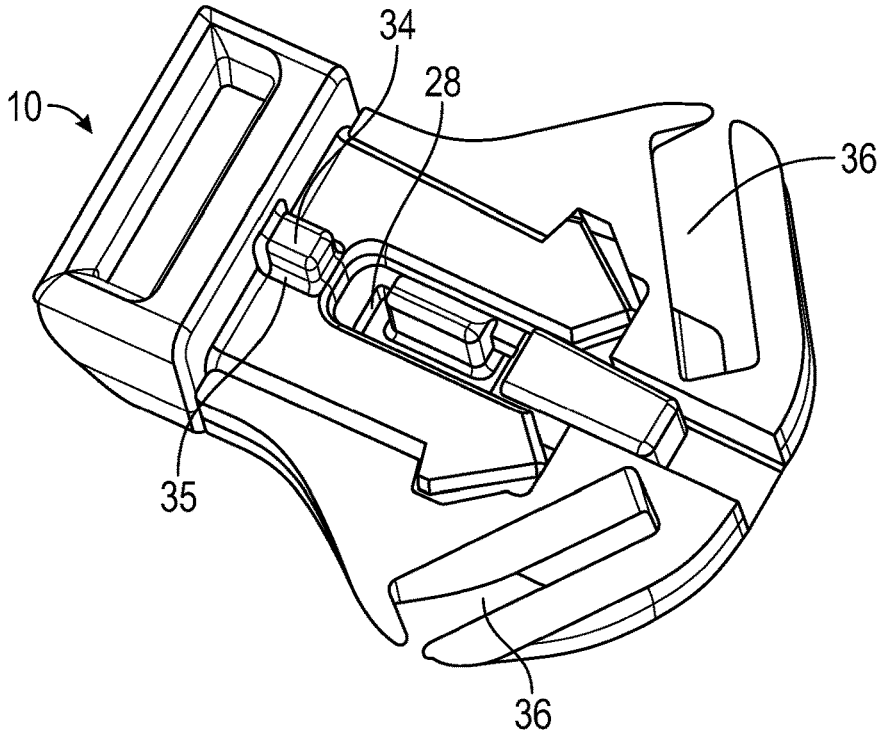
FIG. 5B is a schematic planar cross-sectional view of the safety anchorage device of FIG. 4, showing the device in a second configuration.
Figure 5C:
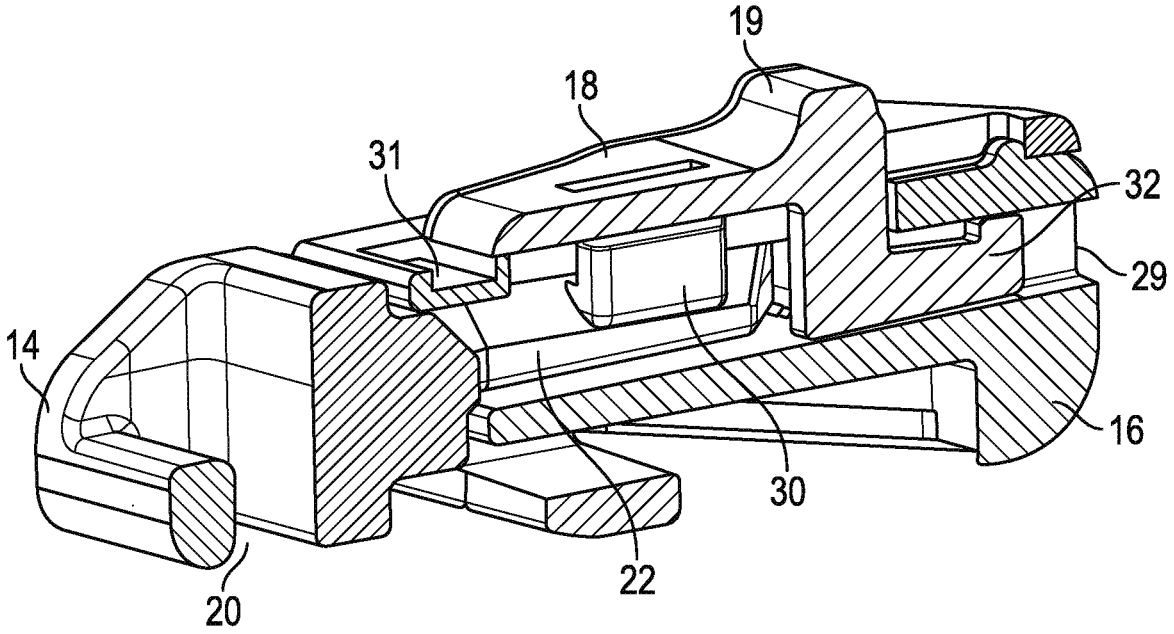
FIG. 5C is a schematic longitudinal cross-sectional view of the safety anchorage device of FIG. 4, showing the device in a first configuration.

Referring to FIGS. 5A, 5B and 5C of the drawings, a planar and longitudinal cross-section through the safety device 10 illustrates the male portion 14 secured within the female portion 16, as viewed from underneath the device 10. An orientation block 34 is provided at the 'lower' or rear surface of the male portion 14, the orientation block 34 comprising a raised part formed integrally with the base of the prongs 22. When the male and female portions 14, 16 are secured together the orientation block 34 is received within a corresponding orientation slot 35, only if the portions 14, 16 are orientated correctly. This prevents the user from securing the safety device 10 incorrectly.

The 'lower' or rear surface of the switch 18B comprises a protrusion which allows the switch to be affixed to the upper surface of the female portion 16 by extending through an elongate aperture 29 in the upper surface of the female portion 16. The aperture 29 can be seen best in FIG. 5C.

The protrusion comprises two segments, a narrow segment 30 and a wider segment 32. When the switch is in a first configuration, as shown in FIGS. 4, 5A and 5C of the drawings, the switch 18 is at a location furthest from the male portion 14 and the narrow segment 30 is positioned between the prongs 22 of the male portion 14. On the upper surface of the female portion 16, indicator 31 is exposed whilst indicator 33 is covered by the switch 18. In this configuration the chinstrap complies with the EN397 safety standard. When a tensile force in the range of 150-200N is applied the prongs 22 will bend inwardly towards the narrow segment 30, allowing the safety device 10 to fail and break apart.

When the switch is in a second configuration, as shown in FIG. 5B of the drawings, the switch is at a location closest to the male portion 14. In this configuration the wider segment 32 is situated between the two prongs 22, and the helmet complies with safety standard EN12492. The indicator 33 is now exposed through an opening in the switch 18, whilst indicator 31 is covered by the switch 18. The wider segment 32 prevents the prongs 22 from bending inwardly at all. Thus, even if a force up to at least 500N is applied, the male and female portions will not separate.

The indicators 31, 33 may be of different colours which contrast, for example yellow and red. They indicate to the user which setting the safety device 10 is set to. In use, the user secures a helmet by fastening the buckle 1. In order to set the correct setting, the user manually slides the switch into the desired position.

Figure 6:
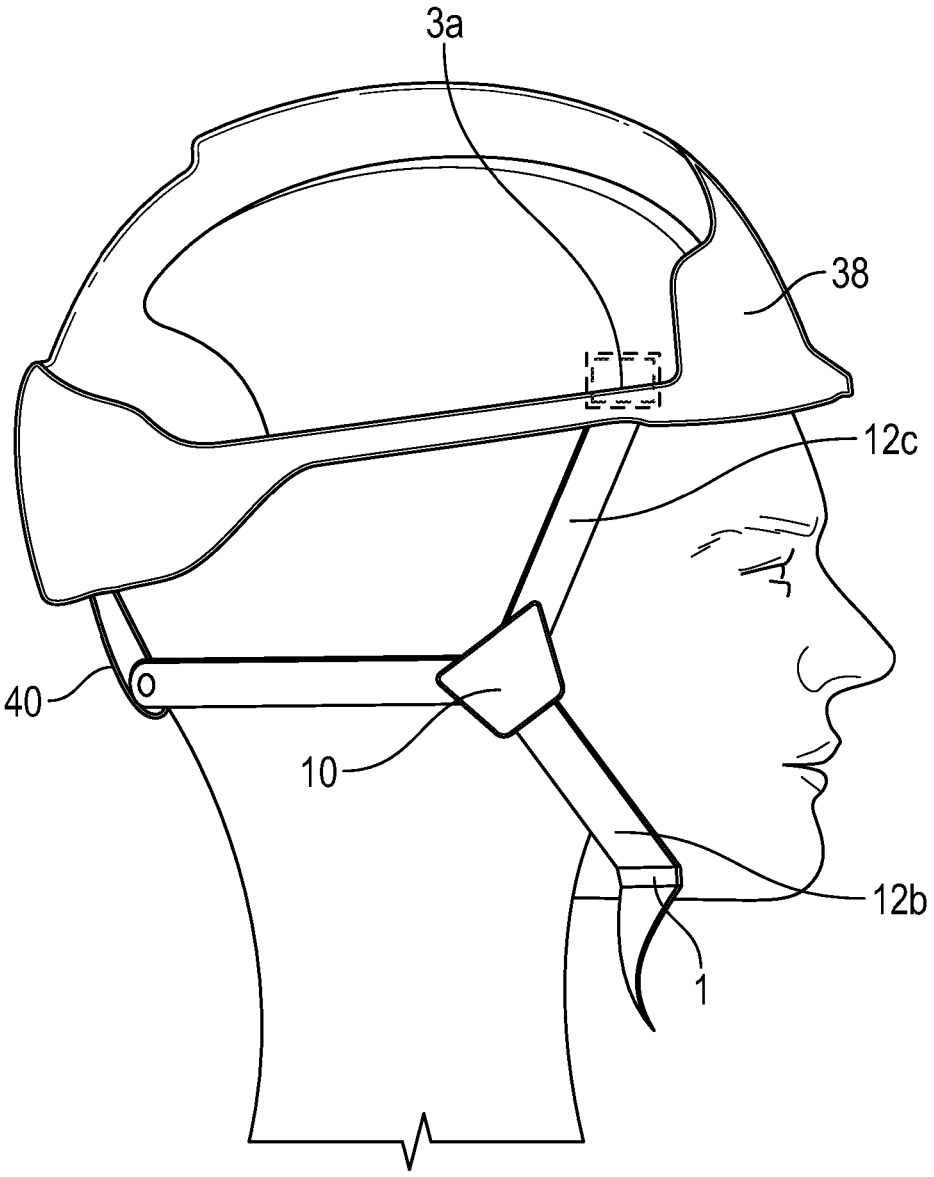
FIG. 6 is a schematic left-hand side-view diagram of a helmet comprising the chinstrap harness of FIG. 3.

Referring to FIG. 6, an exemplary embodiment of how the chinstrap harness may be fixedly attached to a safety helmet 38 shows the helmet connectors 3*a* joining the one end of the chinstrap harness to the inner structure of the helmet. The other ends (denoted above as corresponding to helmet connectors 3*b*) join together around the back of the helmet and loop through a harness loop 40.

Figure 7:
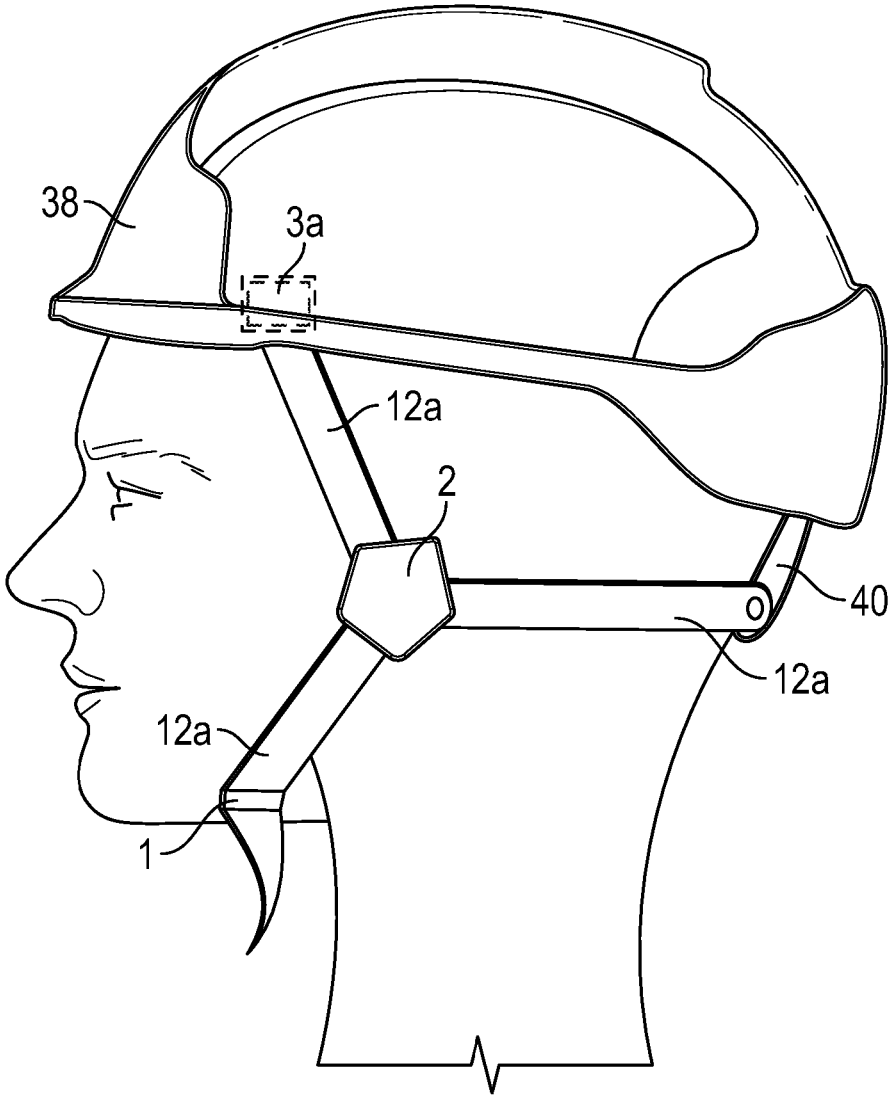
FIG. 7 is a right-hand side view of the helmet of FIG. 6.

Referring to FIG. 7, the same exemplary embodiment of FIG. 6 is shown from the other side, and the conventional anchorage device 2 can be seen. The chinstrap harness can be adjusted by altering the respective distances between the conventional anchorage device 2, the buckle 1 and the safety device 10. Additionally, slide buckles (not shown) may be included along the length of the chinstraps 12, wherein the chinstrap 12 is doubled back through the slide buckle and therefore can be adjusted in length as known in the art. Methods and devices of adjusting chinstrap 12 lengths are known in the art and many alternatives could be used. The invention is not intended to be limited in this regard.

It can be seen from the drawings that the failure point of the harness is not integral with the normal fastening means (i.e. the buckle) of the chinstrap harness. This has the advantage of preserving the integrity of the failure point by limiting its use to those times when the safety device is triggered. This makes the conformity of the helmet with the safety regulations more reliable, and significantly increases the longevity of the chinstrap harness. There is no tool or swapping of parts of the harness or helmet, therefore parts are less likely to be lost and as such, the cost of replacing parts is reduced.

It will be apparent to someone skilled in the art, from the foregoing description that modifications and varieties can be made to the described embodiments, without departing from the scope of the invention as defined by the appended claims.

The invention claimed is:

1. A chinstrap harness for a safety helmet, the chinstrap harness comprising first and second elongate side sections of flexible material, each side section having a first end and an opposing second end, wherein said first end of each side section comprises means to connect said chinstrap harness to a safety helmet, and the opposing second end of each side section includes means for releasably coupling said side sections adjacent a user's face, in use, said first side section incorporating along its length, and intermediate its first and second ends, a safety device coupled across a break in said first side section, said safety device being selectively configurable between a first configuration, in which said safety device is free to release when a tensile force applied to said chinstrap harness exceeds a first predetermined threshold, and a second configuration, in which it can sustain, without releasing, a tensile force of at least a second predetermined threshold, said second predetermined threshold being greater than said first predetermined threshold, wherein said safety device comprises male and female component parts configured, in use, to be connected together across the break, and a manually operable switching mechanism including a switch moveable between a first position corresponding to a first configuration of said chinstrap harness, and a second position corresponding to a second configuration of said chinstrap harness, wherein said means for releasably coupling said first side section and second side section of said chinstrap harness comprises a releasable clip or buckle.

2. A chinstrap harness according to claim 1, wherein said second side section comprises, along its length intermediate its first and second ends, an anchorage device.

3. A chinstrap harness according to claim 2, wherein said anchorage device is configured to allow selective adjustment of the length of said second side section.

4. A chinstrap harness according to claim 1, wherein said safety device is formed integrally with a fixed anchorage device.

5. A chinstrap harness according to claim 1, wherein said switch is manually slidable, in use, along a generally linear path between said first and said second positions by a finger or thumb.

6. A chinstrap harness according to claim 1, wherein said male component part of said safety device comprises at least two substantially parallel, spaced-apart prongs defining a gap therebetween, said prongs being resiliently flexible.

7. A chinstrap harness according to claim 6, wherein said switching mechanism includes an obstruction to which said switch is mechanically coupled, said obstruction being moved away from said gap between said prongs when said switch is moved into said first position, and said obstruction being moved substantially into said gap between said prongs when said switch is moved into said second position.

8. A chinstrap harness according to claim 6, wherein said prongs are configured to flex inwardly towards each other when the tensile force on said chinstrap harness exceeds the first predetermined threshold in the first configuration.

9. A chinstrap harness according to claim 7, wherein said prongs are prevented from flexing inwardly by said obstruction at least when the tensile force on the chinstrap is less than said second predetermined threshold.

10. A chinstrap harness according to claim 1, wherein said side sections are comprised of a woven polymeric fabric which has a tensile strength at least greater than said second predetermined threshold.

* * * * *